US007946046B1

(12) United States Patent
Carver

(10) Patent No.: US 7,946,046 B1
(45) Date of Patent: May 24, 2011

(54) MASONRY LINE STRETCHER SYSTEM

(76) Inventor: Jon O. Carver, Brooksville, FL (US)

( * ) Notice: Subject to any disclaimer, the term of this patent is extended or adjusted under 35 U.S.C. 154(b) by 26 days.

(21) Appl. No.: 12/387,747

(22) Filed: May 7, 2009

(51) Int. Cl.
*G01B 5/14* (2006.01)

(52) U.S. Cl. ..... 33/408; 33/518

(58) Field of Classification Search ..... 33/408, 33/404, 409, 518
See application file for complete search history.

(56) References Cited

U.S. PATENT DOCUMENTS

| | | | | | |
|---|---|---|---|---|---|
| 1,234,282 | A | * | 7/1917 | Butler | 33/408 |
| 2,215,663 | A | * | 9/1940 | Frisk | 33/408 |
| 2,505,606 | A | * | 4/1950 | Coffey | 33/409 |
| 2,523,101 | A | * | 9/1950 | Edixon | 33/408 |
| 2,611,963 | A | | 9/1952 | Zinker | |
| 3,096,588 | A | | 7/1963 | Cook | |
| 3,156,982 | A | * | 11/1964 | Wahlin | 33/408 |
| 3,250,009 | A | * | 5/1966 | Oseka | 33/404 |
| 3,555,688 | A | * | 1/1971 | Smathers | 33/408 |
| 3,626,434 | A | * | 12/1971 | Miller | 33/408 |
| 3,698,089 | A | * | 10/1972 | Huston | 33/408 |
| 4,599,804 | A | * | 7/1986 | Amos | 33/408 |
| 4,937,946 | A | | 7/1990 | Steinhoff | |
| 5,095,633 | A | * | 3/1992 | Barnett | 33/518 |
| 7,263,779 | B1 | * | 9/2007 | Wells | 33/408 |

* cited by examiner

*Primary Examiner* — Christopher W Fulton

(57) ABSTRACT

An elongated base component has primary and secondary ends with a first length and upper and lower and lateral side surfaces. A first cross piece with a second length is operatively located at the primary end of the base component and has an upper end extending upwardly and a lower end extending downwardly. A second cross piece having a third length is coupled to the base component and spaced from the secondary end has an upper end extending upwardly and a lower end extending downwardly. An intermediate means is coupled to the base component intermediate the first and second cross pieces.

5 Claims, 4 Drawing Sheets

FIG 1
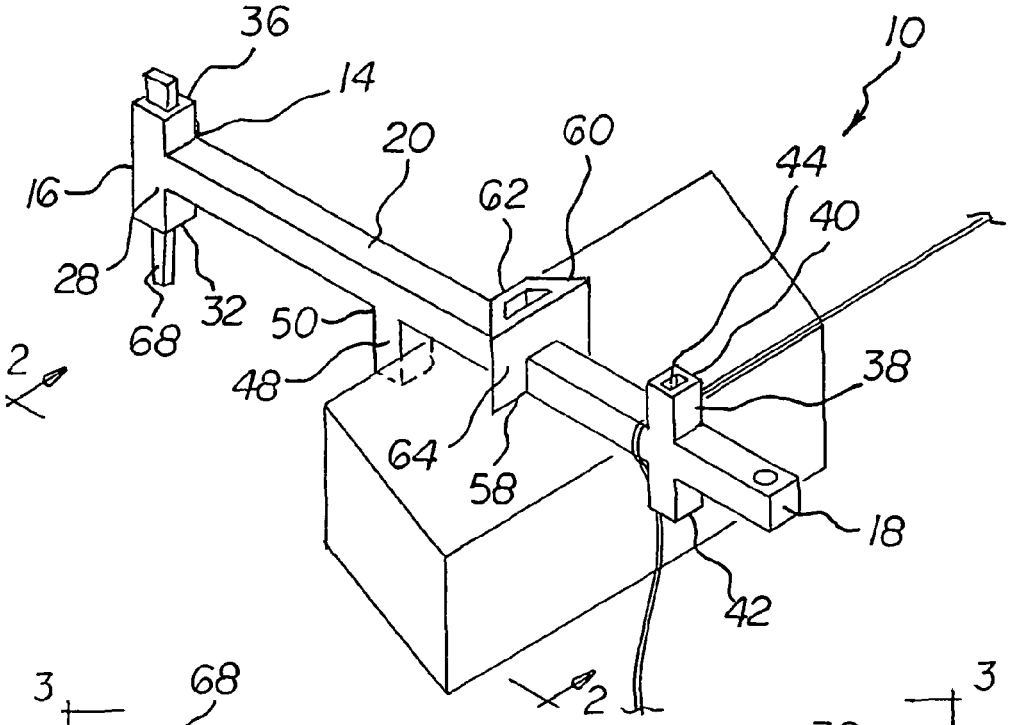
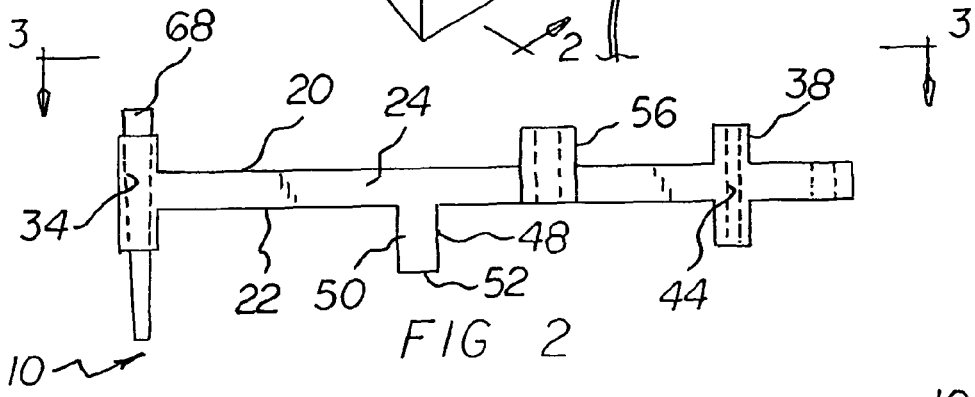
FIG 2
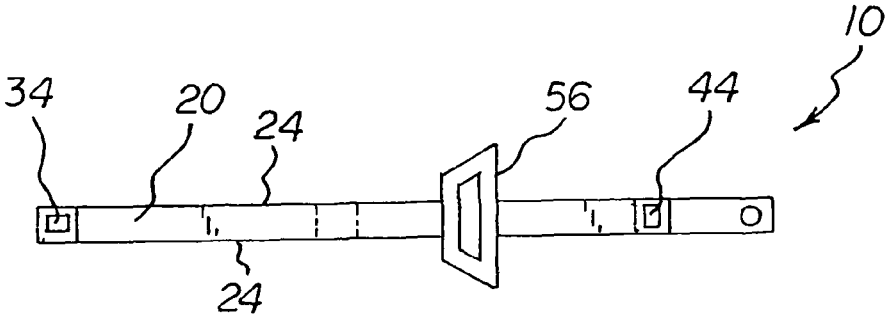
FIG 3

FIG 7
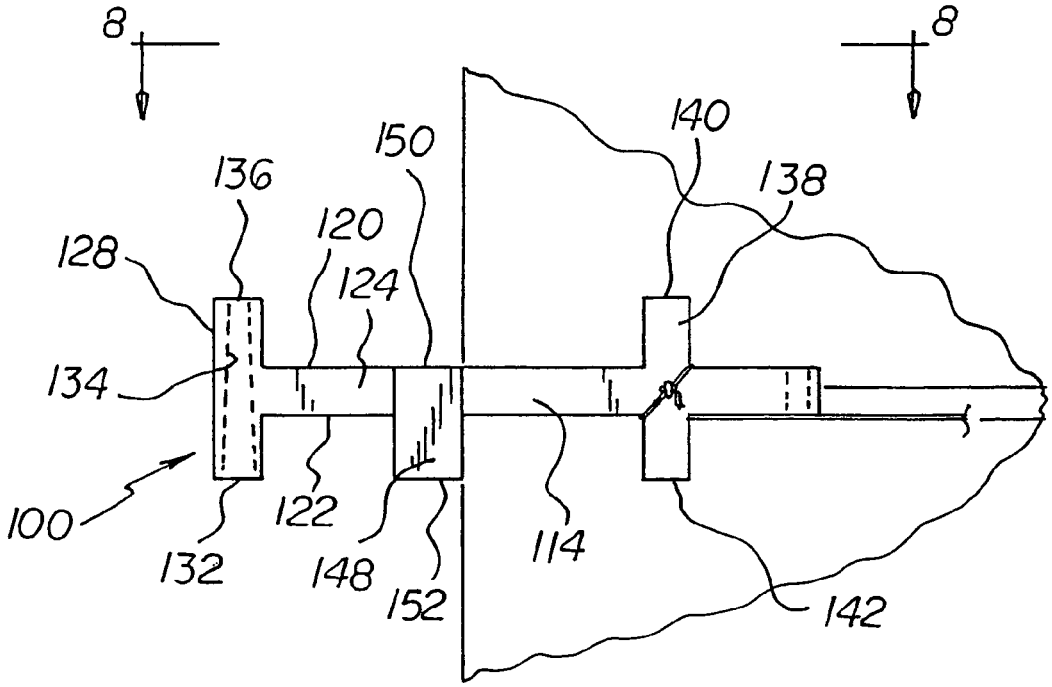
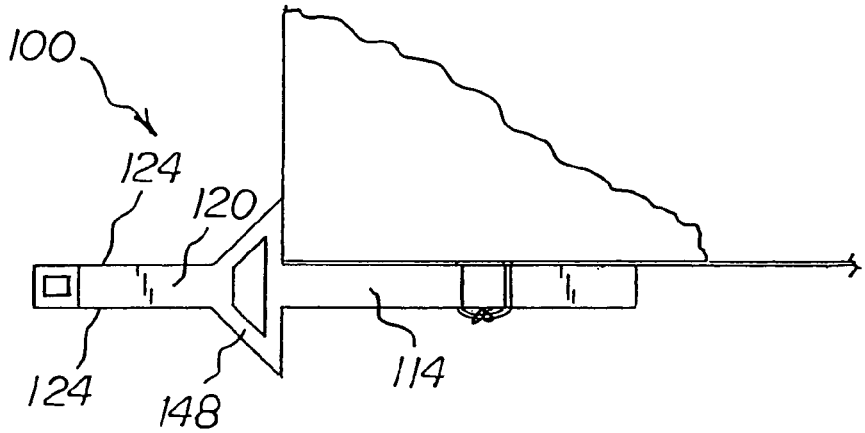
FIG 8

FIG 9
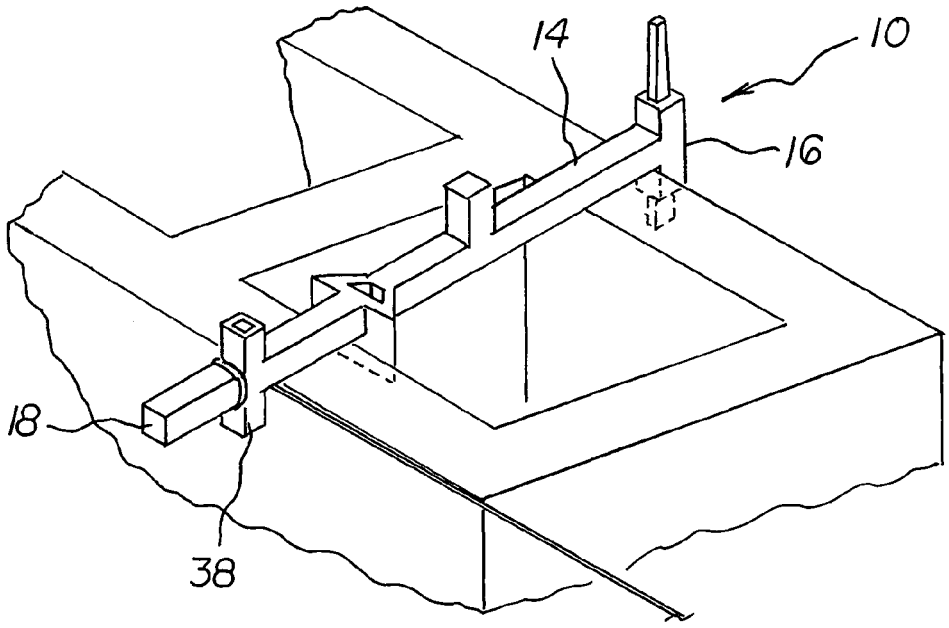
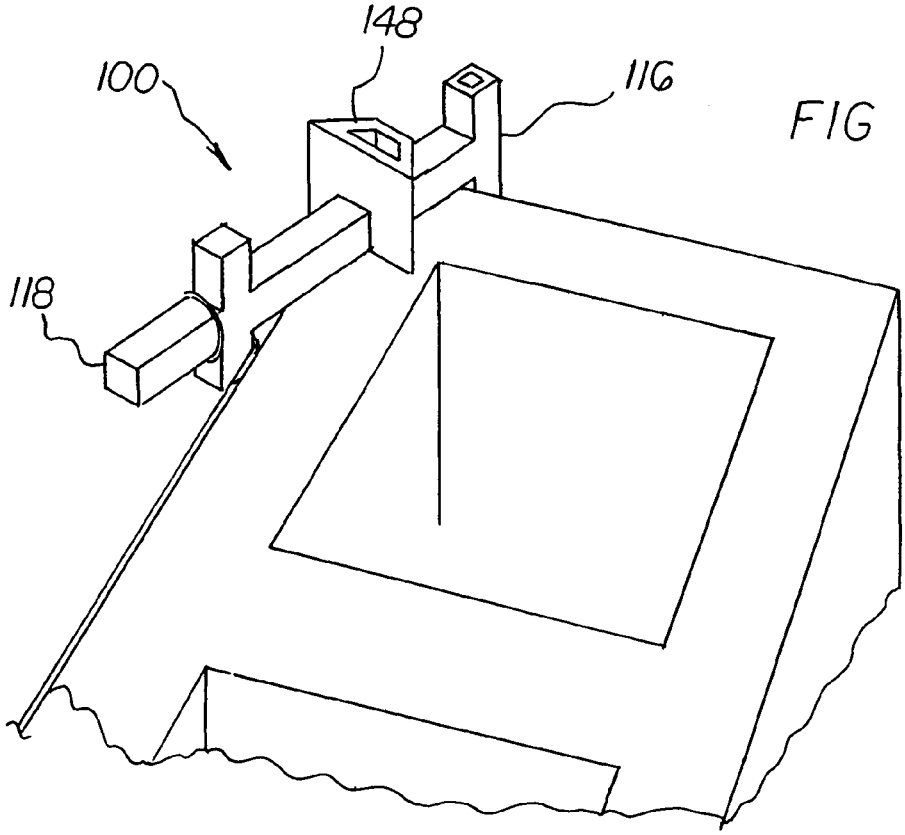
FIG 10

MASONRY LINE STRETCHER SYSTEM

BACKGROUND OF THE INVENTION

1. Field of the Invention

The present invention relates to a masonry line stretcher system and more particularly pertains to allowing one mason to hold a flexible line straight and horizontal while positioning various types of building blocks at a construction site in a safe, reliable, convenient and economical manner.

2. Description of the Prior Art

The use of masonry guides of known designs and configurations is known in the prior art. More specifically, masonry guides of known designs and configurations previously devised and utilized for the purpose of positioning building blocks are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,611,963 issued Sep. 30, 1952 to Zinker relates to a Masonry Line Block. U.S. Pat. No. 3,096,588 issued Jul. 9, 1963 relates to a Masonry Guide Apparatus. U.S. Pat. No. 4,937,946 issued Jul. 3, 1990 to Steinhoff relates to a Masonry Line Stretcher. U.S. Pat. No. 5,003,701 issued Apr. 2, 1991 to Hughes relates to a Masonry Clip. While these devices fulfill their respective, particular objectives and requirements, the aforementioned patents do not describe a masonry line stretcher system that allows one mason to hold a flexible line straight and horizontal while positioning various types of building blocks at a construction site in a safe, reliable, convenient and economical manner.

In this respect, the masonry line stretcher system according to the present invention substantially departs from the conventional concepts and designs of the prior art, and in doing so provides an apparatus primarily developed for the purpose of one mason to hold a flexible line straight and horizontal while positioning various types of building blocks at a construction site in a safe, reliable, convenient and economical manner.

Therefore, it can be appreciated that there exists a continuing need for a new and improved masonry line stretcher system which can be used for one mason to hold a flexible line straight and horizontal while positioning various types of building blocks at a construction site in a safe, reliable, convenient and economical manner. In this regard, the present invention substantially fulfills this need.

SUMMARY OF THE INVENTION

In view of the foregoing disadvantages inherent in the known types of masonry guides of known designs and configurations now present in the prior art, the present invention provides an improved masonry line stretcher system. As such, the general purpose of the present invention, which will be described subsequently in greater detail, is to provide a new and improved masonry line stretcher system and method which has all the advantages of the prior art and none of the disadvantages.

To attain this, the present invention essentially comprises a masonry line stretcher system for helping one mason hold a flexible line straight and horizontal while positioning various types of building blocks at a construction site. The holding is done in a safe, reliable, convenient and economical manner. First provided is an elongated base component in a rectilinear configuration. The base component has a primary end and a secondary end. The base component has a first length of 14 inches plus or minus 20 percent between the primary and secondary ends. The base component has an upper surface and a lower surface and lateral side surfaces between the upper and lower surfaces. All of the surfaces have a width of 1 inch plus or minus 20 percent.

Next provided is a first cross piece. The first cross piece is operatively located at the primary end of the base component. The first cross piece has an upper end extending upwardly from the upper surface of the base component and a lower end extending downwardly from the lower surface of the base component. The first cross piece has a second length of 2 inches plus or minus 20 percent between its upper and lower ends. The first cross piece has surfaces with a width of 0.5 inches plus or minus 20 percent. A trapezoidal aperture extends through the first cross piece between the upper and lower ends.

Next provided is a second cross piece. The second cross piece is coupled to the base component and is spaced from the secondary end by 2 inches plus or minus 20 percent. The second cross piece has an upper end extending upwardly from the upper surface of the base component and a lower end extending downwardly from the lower surface of the base component. The second cross piece has a third length of 2 inches plus or minus 20 percent between its upper and lower ends. The second cross piece has surfaces with a width of 0.5 inch plus or minus 20 percent. An aperture extends through the second cross piece between its upper and lower ends.

Next provided is a third cross piece coupled to the base component. The third cross piece is spaced from the primary end by 7 inches plus or minus 20 percent. The third cross piece has a lower end at the base component and an upper end extending upwardly from the upper surface of the base component. The third cross piece has a fourth length of 1 inch plus or minus 20 percent between its upper and lower ends. The third cross piece has a trapezoidal configuration. The third cross piece has a small surface facing the primary end. The third cross piece has a large surface facing the secondary end which extends laterally and upwardly from the base component.

Next provided is a fourth cross piece coupled to the base component and spaced from the primary end by 5 inches plus or minus 20 percent. The fourth cross piece has an upper end at the base component and a lower end extending downwardly from the lower surface of the base component. The fourth cross piece has a fifth length of 1 inch plus or minus 20 percent between its upper and lower ends. The fourth cross piece has surfaces with a width of 0.5 inch plus or minus 20 percent.

Lastly, a pin in a trapezoidal configuration is provided. The pin is removably positionable in the trapezoidal aperture of the first cross piece.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved masonry line stretcher system which has all of the advantages of the prior art masonry guides of known designs and configurations and none of the disadvantages.

It is another object of the present invention to provide a new and improved masonry line stretcher system which may be easily and efficiently manufactured and marketed.

It is further object of the present invention to provide a new and improved masonry line stretcher system which is of durable and reliable constructions.

An even further object of the present invention is to provide a new and improved masonry line stretcher system which is susceptible of a low cost of manufacture with regard to both materials and labor, and which accordingly is then susceptible of low prices of sale to the consuming public, thereby making such masonry line stretcher system economically available to the buying public.

Even still another object of the present invention is to provide a masonry line stretcher system for one mason to hold a flexible line straight and horizontal while positioning various types of building blocks at a construction site in a safe, reliable, convenient and economical manner.

Lastly, it is an object of the present invention to provide a new and improved base component having primary and secondary ends with a first length and upper and lower and lateral side surfaces. A first cross piece with a second length is operatively located at the primary end of the base component and has an upper end extending upwardly and a lower end extending downwardly. A second cross piece having a third length is coupled to the base component and spaced from the secondary end has an upper end extending upwardly and a lower end extending downwardly. An intermediate means is coupled to the base component intermediate the first and second cross pieces.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a masonry line stretcher system constructed in accordance with the principles of the present invention with a line being stretched from the system while coupled to the top of a brick.

FIG. 2 is a side elevational view of the system taken along line 2-2 of FIG. 1.

FIG. 3 is a plan view of the system taken along line 3-3 of FIG. 2.

FIG. 7 is a perspective illustration of a masonry line stretcher system as shown in the FIGS. 5 and 6 but with a line being stretched from the system while coupled to a corner of a structure rather than to a side.

FIG. 8 is a plan view of the system taken along line 8-8 of FIG. 7.

FIG. 9 is a perspective illustration of a masonry line stretcher system constructed in accordance with the primary embodiment of the present invention with a line being stretched from the system while the system is spanning the top of a cinder block.

FIG. 10 is a perspective illustration of a masonry line stretcher system constructed in accordance with the alternate embodiment of the present invention with a line being stretched from the system while the system is spanning the corner of a cinder block.

The same reference numerals refer to the same parts throughout the various Figures.

DESCRIPTION OF THE PREFERRED EMBODIMENT

Figure 4:
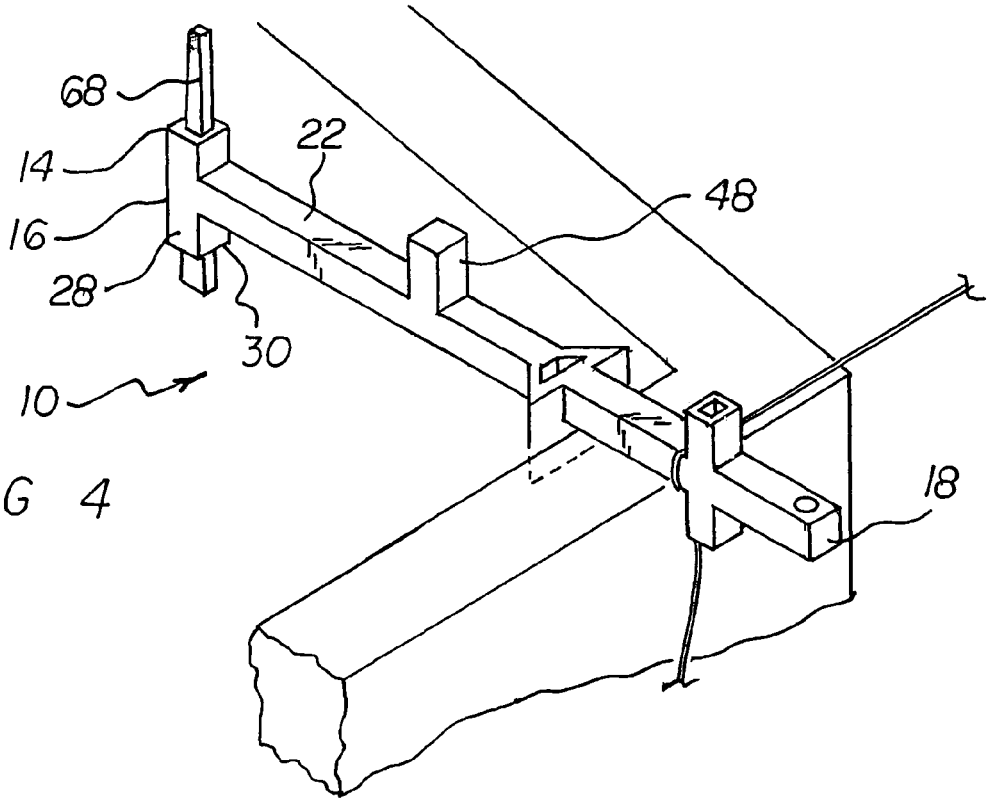
FIG. 4 is a perspective illustration of a masonry line stretcher system as shown in the prior Figures but with the line being stretched from the system while coupled to a cinder block rather than to a brick.

With reference now to the drawings, and in particular to FIG. 1 thereof, the preferred embodiment of the new and improved masonry line stretcher system embodying the principles and concepts of the present invention and generally designated by the reference numeral 10 will be described.

The present invention, the masonry line stretcher system 10 is comprised of a plurality of components. Such components in their broadest context include an elongated base component, a fist cross piece, a second cross piece and an intermediate means. Such components are individually configured and correlated with respect to each other.

The primary embodiment of the invention is a masonry line stretcher system 10 for helping one mason hold a flexible line straight and horizontal while positioning various types of building blocks at a construction site. The holding is done in a safe, reliable, convenient and economical manner. Note FIG. 1. First provided is an elongated base component 14 in a rectilinear configuration. The base component has a primary end 16 and a secondary end 18. The base component has a first length of 14 inches plus or minus 20 percent between the primary and secondary ends. The base component has an upper surface 20 and a lower surface 22 and lateral side surfaces 24 between the upper and lower surfaces. All of the surfaces have a width of 1 inch plus or minus 20 percent.

Next provided is a first cross piece 28. The first cross piece is operatively located at the primary end of the base component. The first cross piece has an upper end 30 extending upwardly from the upper surface of the base component and a lower end 32 extending downwardly from the lower surface of the base component. The first cross piece has a second length of 2 inches plus or minus 20 percent between its upper and lower ends. The first cross piece has surfaces with a width of 0.5 inches plus or minus 20 percent. A trapezoidal aperture 34 extends through the first cross piece between the upper and lower ends.

Next provided is a second cross piece 38. The second cross piece is coupled to the base component and is spaced from the secondary end by 2 inches plus or minus 20 percent. The second cross piece has an upper end 40 extending upwardly from the upper surface of the base component and a lower end 42 extending downwardly from the lower surface of the base component. The second cross piece has a third length of 2 inches plus or minus 20 percent between its upper and lower ends. The second cross piece has surfaces with a width of 0.5 inch plus or minus 20 percent. An aperture 44 extends through the second cross piece between its upper and lower ends.

Next provided is a third cross piece 56 coupled to the base component. The third cross piece is spaced from the primary end by 7 inches plus or minus 20 percent. The third cross piece has a lower end 58 at the base component and an upper end 60 extending upwardly from the upper surface of the base component. The third cross piece has a fourth length of 1 inch plus or minus 20 percent between its upper and lower ends. The third cross piece has a trapezoidal configuration. The third cross piece has a small surface 62 facing the primary end. The third cross piece has a large surface 64 facing the secondary end which extends laterally and upwardly from the base component.

Next provided is a fourth cross piece 48 coupled to the base component and spaced from the primary end by 5 inches plus or minus 20 percent. The fourth cross piece has an upper end 50 at the base component and a lower end 52 extending downwardly from the lower surface of the base component. The fourth cross piece has a fifth length of 1 inch plus or minus 20 percent between its upper and lower ends. The fourth cross piece has surfaces with a width of 0.5 inch plus or minus 20 percent.

Lastly, a pin 68 in a trapezoidal configuration is provided. The pin is removably positionable in the trapezoidal aperture of the first cross piece.

Figure 5:
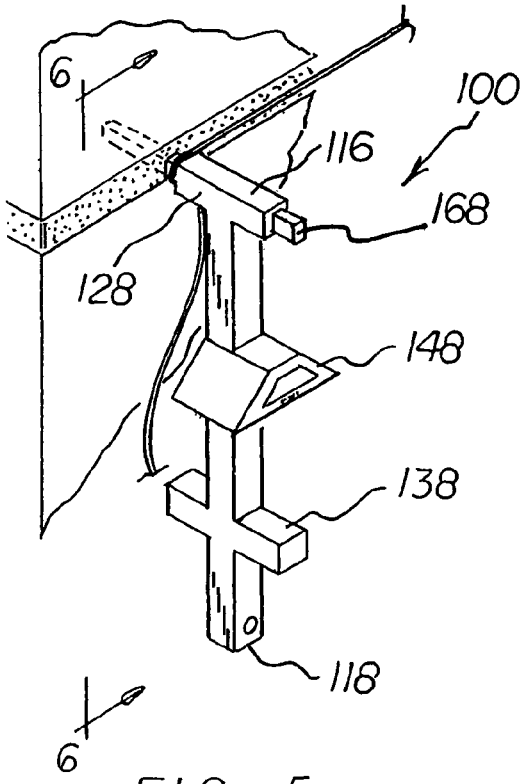
FIG. 5 is a perspective illustration of a masonry line stretcher system constructed in accordance with an alternate embodiment of the invention with a line being stretched from the system while fit into a mortar joint on the side of bricks/blocks.
Figure 6:
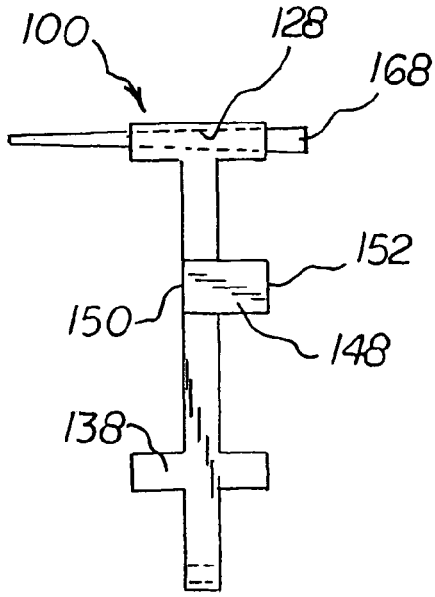
FIG. 6 is a side elevational view of the system taken along line 6-6 of FIG. 5.

In an alternate embodiment of the invention, the fourth cross piece is not present. This alternate embodiment is shown in FIG. 5. As in the primary embodiment, the masonry line stretcher system 100 has an elongated base component 114 in a rectilinear configuration. The base component has a primary end 116 and a secondary end 118 with a first length of 10 inches plus or minus 20 percent between the primary and secondary ends. The base component has an upper surface 120 and a lower surface 122 with lateral side surfaces 124 between the upper and lower surfaces. All of the surfaces have a width of 1 inch plus or minus 20 percent.

Also, as in the primary embodiment, in the alternate embodiment, a first cross piece 128 is operatively located at the primary end of the base component. The first cross piece has an upper end 130 extending upwardly from the upper surface of the base component and a lower end 132 extending downwardly from the lower surface of the base component. The first cross piece has a second length of 2 inches plus or minus 20 percent between its upper and lower ends. The first cross piece has surfaces with a width of 0.5 inches plus or minus 20 percent. A trapezoidal aperture 134 extends through the first cross piece between the upper and lower ends.

Again, as in the primary embodiment, in the alternate embodiment a second cross piece 138 is coupled to the base component. The second cross piece is spaced from the secondary end by 2 inches plus or minus 20 percent. The second cross piece has an upper end 140 extending upwardly from the upper surface of the base component and a lower end 42 extending downwardly from the lower surface of the base component. The second cross piece has a third length of 2 inches plus or minus 20 percent between its upper and lower ends. The second cross piece has surfaces with a width of 0.5 inch plus or minus 20 percent.

Further, in the alternate embodiment, as in the primary embodiment, a third cross piece 148 is coupled to the base component. The third cross piece is spaced from the primary end by 5 inches plus or minus 20 percent. The third cross piece has a lower end 150 at the base component and an upper end 152 extending upwardly from the upper surface of the base component. The third cross piece has a fourth length of 2 inches plus or minus 20 percent between its upper and lower ends. The third cross piece has a trapezoidal configuration with a small surface facing the primary end. The third cross piece also has a large surface facing the secondary end extending laterally and upwardly from the base component.

Lastly, in the alternate embodiment, a pin 168 in a trapezoidal configuration is provided. The pin is removably positionable in the trapezoidal aperture of the first cross piece.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A masonry line stretcher system comprising, in combination:

an elongated base component having primary and secondary ends with a first length, the base component having an upper and lower surface with lateral side surfaces;

a first cross piece operatively located at the primary end of the base component and having an upper end extending upwardly and a lower end extending downwardly, the first cross piece having a second length, the first cross piece forming coplanar abutment surfaces on both sides of the base component;

a second cross piece coupled to the base component and spaced from the secondary end, the second cross piece having an upper end extending upwardly and a lower end extending downwardly, the second cross piece having a third length, the second cross piece forming coplanar abutment surfaces on both sides of the base component; and an intermediate means coupled to the base component intermediate the first and second cross pieces, the intermediate means forming parallel abutment surfaces extending from three sides of the base component, the abutment surfaces of the intermediate means being spaced from the abutment surfaces of the second cross piece by 2 inches plus or minus 20 percent.

2. A masonry line stretcher system comprising, in combination:

an elongated base component having primary and secondary ends with a first length, the base component having an upper and lower surface with lateral side surfaces;

a first cross piece operatively located at the primary end of the base component and having an upper end extending upwardly and a lower end extending downwardly, the first cross piece having a second length;

a second cross piece coupled to the base component and spaced from the secondary end, the second cross piece having an upper end extending upwardly and a lower end extending downwardly, the second cross piece having a third length; and an intermediate means coupled to the base component intermediate the first and second cross pieces, wherein the intermediate means is a third cross piece coupled to the base component and spaced from the primary end by 7 inches plus or minus 20 percent, the third cross piece having a lower end at the base component and an upper end extending upwardly from the upper surface of the base component, the third cross piece has a fourth length of 1 inch plus or minus 20 percent between its upper and lower ends, the third cross piece having a trapezoidal configuration with a small surface facing the primary end and a large surface facing the secondary end and extending laterally and upwardly from the base component.

3. The system as set forth in claim 2 wherein the intermediate means further includes a fourth cross piece coupled to the base component and spaced from the primary end by 5 inches plus or minus 20 percent, the fourth cross piece having an upper end at the base component and a lower end extending downwardly from the lower surface of the base component, the fourth cross piece having a fourth length of 1 inch plus or minus 20 percent between its upper and lower ends, the fourth cross piece having surfaces with a width of 0.5 inch plus or minus 20 percent.

4. A masonry line stretcher system for helping one mason hold a flexible line straight and horizontal while positioning various types of building blocks at a construction site, the holding being done in a safe, reliable, convenient and economical manner, the system comprising, in combination:

an elongated base component in a rectilinear configuration having a primary end and a secondary end with a first length of 10 inches plus or minus 20 percent between the primary and secondary ends, the base component having an upper surface and a lower surface with lateral side surfaces between the upper and lower surfaces, all of the surfaces having a width of 1 inch plus or minus 20 percent;

a first cross piece operatively located at the primary end of the base component and having an upper end extending upwardly from the upper surface of the base component and a lower end extending downwardly from the lower surface of the base component, the first cross piece having a second length of 2 inches plus or minus 20 percent between its upper and lower ends, the first cross piece having surfaces with a width of 0.5 inches plus or minus 20 percent, a trapezoidal aperture extending through the first cross piece between the upper and lower ends;

a second cross piece coupled to the base component and spaced from the secondary end by 2 inches plus or minus 20 percent, the second cross piece having an upper end extending upwardly from the upper surface of the base component and a lower end extending downwardly from the lower surface of the base component, the second cross piece having a third length of 2 inches plus or minus 20 percent between its upper and lower ends, the second cross piece having surfaces with a width of 0.5 inch plus or minus 20 percent;

a third cross piece coupled to the base component and spaced from the primary end by 5 inches plus or minus 20 percent, the third cross piece having a lower end at the base component and an upper end extending upwardly from the upper surface of the base component, the third cross piece having a fourth length of 2 inches plus or minus 20 percent between its upper and lower ends, the third cross piece having a trapezoidal configuration with a small surface facing the primary end and a large surface facing the secondary end and extending laterally and upwardly from the base component; and a pin in a trapezoidal configuration removably positionable in the trapezoidal aperture of the first cross piece.

5. A masonry line stretcher system for helping one mason hold a flexible line straight and horizontal while positioning various types of building blocks at a construction site, the holding being done in a safe, reliable, convenient and economical manner, the system comprising, in combination:

an elongated base component in a rectilinear configuration having a primary end and a secondary end with a first length of 14 inches plus or minus 20 percent between the primary and secondary ends, the base component having an upper surface and a lower surface with lateral side surfaces between the upper and lower surfaces, all of the surfaces having a width of 1 inch plus or minus 20 percent;

a first cross piece operatively located at the primary end of the base component and having an upper end extending upwardly from the upper surface of the base component and a lower end extending downwardly from the lower surface of the base component, the first cross piece having a second length of 2 inches plus or minus 20 percent between its upper and lower ends, the first cross piece having surfaces with a width of 0.5 inches plus or minus 20 percent, a trapezoidal aperture extending through the first cross piece between the upper and lower ends;

a second cross piece coupled to the base component and spaced from the secondary end by 2 inches plus or minus 20 percent, the second cross piece having an upper end extending upwardly from the upper surface of the base component and a lower end extending downwardly from the lower surface of the base component, the second cross piece having a third length of 2 inches plus or minus 20 percent between its upper and lower ends, the second cross piece having surfaces with a width of 0.5 inch plus or minus 20 percent, an aperture extending through the second cross piece between its upper and lower ends;

a third cross piece coupled to the base component and spaced from the primary end by 7 inches plus or minus 20 percent, the third cross piece having a lower end at the base component and an upper end extending upwardly from the upper surface of the base component, the third cross piece having a fourth length of 1 inch plus or minus 20 percent between its upper and lower ends, the third cross piece having a trapezoidal configuration with a small surface facing the primary end and a large surface facing the secondary end extending laterally and upwardly from the base component;

a fourth cross piece coupled to the base component and spaced from the primary end by 5 inches plus or minus 20 percent, the fourth cross piece having an upper end at the base component and a lower end extending downwardly from the lower surface of the base component, the fourth cross piece having a fifth length of 1 inch plus or minus 20 percent between its upper and lower ends, the fourth cross piece having surfaces with a width of 0.5 inch plus or minus 20 percent; and a pin in a trapezoidal configuration removably positionable in the trapezoidal aperture of the first cross piece.

* * * * *